United States Patent [19]

Felder

[11] Patent Number: 4,943,057

[45] Date of Patent: Jul. 24, 1990

[54] TORSION-IMPARTING BLOCKING PRACTICE SLED

[76] Inventor: James G. Felder, 3577 Gaston Ave., Montgomery, Ala. 36105

[21] Appl. No.: 391,991

[22] Filed: Aug. 10, 1989

[51] Int. Cl.[5] ..... A63B 69/00

[52] U.S. Cl. ..... 273/55 R

[58] Field of Search ..... 273/55 R, 55 A, 55 B; 272/130–141

[56] References Cited

U.S. PATENT DOCUMENTS

| | | | |
|---|---|---|---|
| 2,644,334 | 7/1953 | Perry | 273/55 R |
| 3,329,428 | 7/1967 | Moran | 273/55 R |
| 3,365,947 | 1/1968 | Janich, III et al. | 273/55 R |
| 3,514,105 | 5/1970 | Pillard | 273/55 R |
| 3,544,106 | 12/1970 | Barrett | 272/137 |
| 3,578,324 | 5/1971 | Alvey | 273/55 R |
| 3,674,265 | 7/1972 | Sheets | 273/55 R |
| 3,825,260 | 7/1974 | Thomas, Sr. | 273/55 R |
| 3,997,160 | 12/1976 | George | 273/55 R |
| 4,477,076 | 10/1984 | Monaco | 273/55 R |
| 4,802,670 | 2/1989 | Smith | 273/55 R |

*Primary Examiner*—Theatrice Brown
*Attorney, Agent, or Firm*—Low & Low

[57] ABSTRACT

A practice blocking apparatus including a blocking pad having means not only to yieldably resist blocking pressure thereagainst, but also to impart torsional forces thereto to provide greater practice realism to the athlete.

13 Claims, 1 Drawing Sheet

FIG. 1
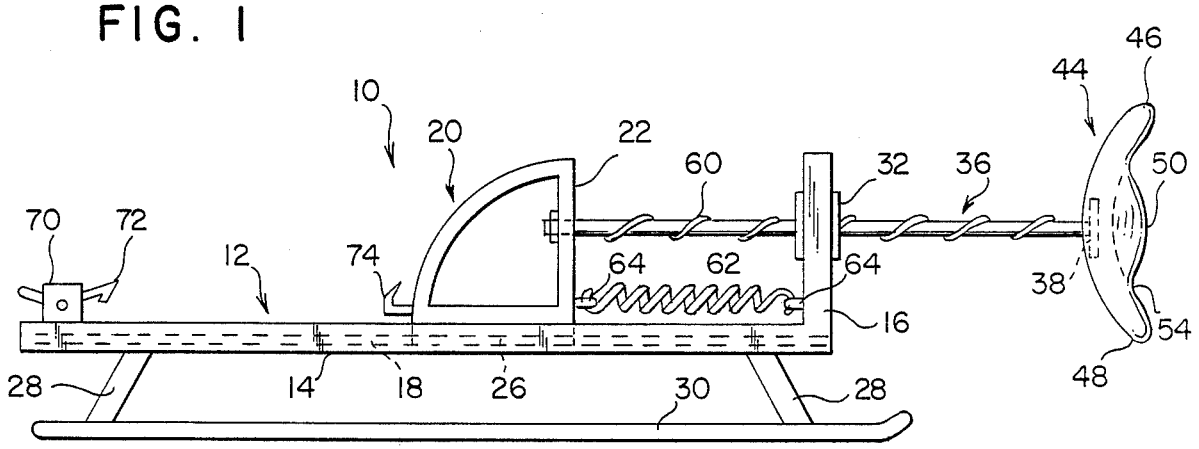
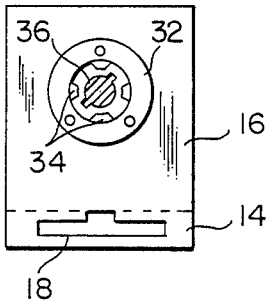
FIG. 2
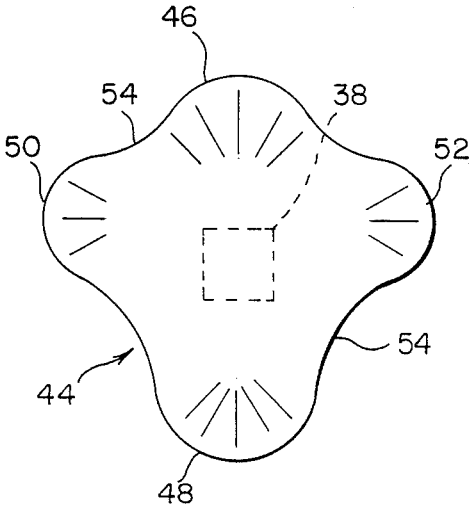
FIG. 3
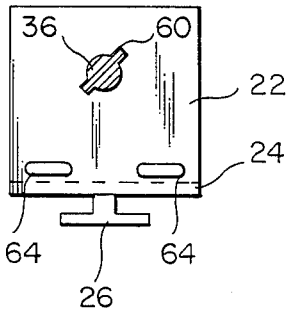
FIG. 4

TORSION-IMPARTING BLOCKING PRACTICE SLED

BACKGROUND OF THE INVENTION

It is well-known in the art to provide blocking sleds or like football defensive training equipment wherein a blocking pad or dummy is rearwardly resiliently yieldable under forceful blocking pressure by a football player. Apparatus or sleds of this type may be detachably anchored to the ground or utilize the weight of the equipment itself, in addition to spring pressure on the blocking pad, to provide resistance to the crouched onslaught of the player.

Blocking sleds of this nature may be found in the U.S. Patent and Trademark Office classification of Class 273, Subclass 55, among others, and exemplary patents to facilitate understanding of the art include:

| | |
|---|---|
| 3,329,428 - Moran | 3,674,265 - Sheets et al |
| 3,365,947 - Janich et al | 4,447,056 - Dalton |
| 3,427,021 - Donato | 4,477,076 - Monaco |
| 3,514,105 - Pillard | |

While these devices provide sound physical training in terms of effort and resistance, they lack a key aspect present in human response to head-on blocking forces, namely, the effort of the blocked player to elude the frontal pushback.

Upon commencement of dug-in forward movement against an offensive (or defensive) lineman at the start of a play, the blocked lineman reflexively and by training seeks to turn and twist away, thereby adding lateral and torsional forces to the resistance otherwise encountered by the blocking lineman. Training for such motion is not addressed by sleds and like training apparatus capable only of rearward-yielding movement.

BRIEF SUMMARY OF THE INVENTION

The present invention improves upon known blocking sleds and like training apparatus by providing a twisting or torsional motion to the blocking pad which is superimposed upon the rearward resisting force, thereby providing the athlete with a more difficult exercise and more nearly approaching actual blocking conditions.

In accordance with the invention, means are provided to impart a rotational force to the blocking pad as the same is moved rearwardly upon forward assault by the trainee. Further, the more rapidly the blocking pad is forced rearwardly, the greater the torsional force encountered by the player as the blocking pad seeks to "escape", so to speak.

Further, the means to achieve this highly desirable additional training benefit does not add significantly to the manufacturing expense of the blocking sled while yet providing the wanted training and practice to the player.

Blocking sleds quite commonly are provided with dummies or blocking pads mounted at the forward end of one or more rigid rearwardly extending rods which are mounted for sliding movement within a surrounding tubular member against the force of a tension spring assembly which normally urges the rod and thereby the blocking pad or dummy to its foremost position, whereat it is attacked by the practicing player exerting maximum pushing effect thereon to move the pad rearwardly.

In the present invention, in its simplest form, the slidable mounting rod for the pad is coupled to its tubular support through a helical spline assembly, as a consequence of which, the aforesaid rearward pressure on the dummy and horizontal support rod will effect automatic twisting movement of the blocking pad as it moves rearwardly, forcing the practicing player to compensate in stance, leg position and push, and exerted effort for the shifting torsional movement of the pad, which generally emulates the twisting motion of the blocked player in seeking to elude the block before him.

BRIEF DESCRIPTION OF THE DRAWINGS

The invention will be better understood when taken with the accompanying drawings, in which:

FIG. 1 is a side elevation of an illustrative blocking sled in accordance with the invention;

FIG. 2 is a front elevation of the sled mainframe forward portion showing the helical spline bushing and the frame keyway for the slide;

FIG. 3 is a front elevation of a typical blocking pad; and,

FIG. 4 is a front elevation of the front plate of the slide frame to which the rearmost end of the spline bar is secured.

DESCRIPTION OF THE PREFERRED EMBODIMENT

Referring to the drawings, there is shown at 10 a blocking sled or like practice apparatus incorporating the invention. The same includes a generally L-shaped rigid metal frame 12 having a horizontal track portion 14 and a front wall 16. Slide track means 18 is provided in the track portion 14, and is illustratively shown as an inverted T-slot which extends substantially the entire length of the frame portion 14 for reception therein of a slide block 20.

The horizontal frame portion may be fabricated from heavy gauge steel, for example, and appropriately longitudinally bent or folded to define the T-slot 18, or the latter may be defined by longitudinal inserts within the periphery of the metal frame, or by other conventional mechanical expedients.

The slide block 20 includes a forward upright wall 22 and a bottom wall 24, the latter having depending therefrom a key slide member having an appropriate configuration complementary to the slideway 18, as, illustratively, T-slide key 26.

The L-frame 12 is positioned at an appropriate height above the ground surface by a plurality of legs 28 along either longitudinal side thereof and connecting to a pair of laterally spaced ground rails 30, one being shown. The ground rails may be generally flat in the nature of skis, as is known, to facilitate sliding of the sled to a desired position on the ground surface, and thereafter securing the same against sliding movement as by anchor pins driven through apertures in the skis, or other comparable securement means, as is known in the art. In like manner, the practice device of the invention may be used within a gymnasium or other sports facility by blocking the rear portion of the frame against a wall, for example.

The upright wall 16 of the L-frame includes an aperture therethrough in which is rigidly mounted a toothed bushing 32 having one or more radially inwardly extending teeth 34 thereon. The bushing teeth are sufficiently thick and of axial length to resist damage from torsional forces thereagainst in use. While four such teeth are illustratively shown in FIG. 2, a fewer number as two or even one may suffice, depending upon the forces expected against the same. In like manner, the teeth may be luricated or including reduced friction material as polytetrafluoroethylene on their surfaces.

Cooperating with the toothed bushing and received therein for axial movement therethrough is an elongated bar or rod 36. The rear end of the bar 36 is secured to wall 22 of sliding block 20 so as to be axially fixed thereto but rotatable with respect thereto, as by means of a C-clip 40 cooperating with a reduced spindle end of the bar as at 42 extending through an aperture in wall 22. Other well known means of rotatably mounting bar 36 on wall 22 may be employed, as bushing and nut assemblies, etc., to achieve this purpose.

As seen in the drawings, the free end of rod 36 has mounted on an enlarged end 38 thereof in known manner a blocking pad or dummy 44. Preferably, to better achieve the objects of the invention, the blocking pad 44 is not merely a conventional thickened generally flat pad or cushion, but is generally cupped or dished to be centrally recessed as shown and of a broadly lobed or star-like form, including forwardly extending curved areas at the top, bottom and on either side at 46, 48, 50, 52, respectively, and defining therebetween generally concave and cutaway areas as at 54.

The twist bar 36 itself is provided with one or more of helical ribs or splines 60, two being shown, which extend substantially the entire working length of the bar. The splines 60 have a fairly shallow twist or pitch so as not to easily bind in bushing 32 upon application of axial force, but sufficient to impart a significant torsional or twisting motion to blocking pad 44 when pushed rearwardly, or to the left as seen in FIG. 1.

As is known in the art, resilient means, as strong tension springs 62 are provided to resist rearward sliding movement of slide block 20 and the blocking pad extending forwardly therefrom. A plurality of such springs 62, one being shown, are connected between the front frame wall 16 and the front plate 22 of the slide block as by eye loops 64 with which the spring ends interengage.

Accordingly, at a forward rest position of the slide block 20 against a suitable forward stop as urged by springs 62 or merely the forward tension limit of the springs proper, the bushing 32 and the spline bar 36 will so positioned that the blocking pad is in the desired position, as generally upright. This positioning can be determined by the location of a stop block, the length of the springs, by adjustable positioning of the bushing in wall 16, by relative adjustment and affixing of the blocking pad 44 to the rod distal end 38, or by any convenient means.

It will be seen, that with the rails or skids 30 anchored in place or otherwise secured, that blocking forces exerted by a player against pad 44 will not only be resisted by the force of springs 62 or like resistant means, but also the blocking pad 44 will be caused to turn or twist as rod 36 is driven rearwardly under assaulting force as the rod spline or rib 60 passes through the fixed key bushing 32.

In so doing, the player will be required to shift and perfect his leg stance and body position to counter this relative "escaping" motion of the pad, which simulates the twisting or turnaway motion of a player being so blocked. Thus, for example, the player will be required to dèvelop a wider leg base or stance in view of the twisting pad, and in like manner to cope effectively with that torsional motion, the player will be required to develop upper body blocking techniques.

In this connection, the effect is more pronounced by virtue of the lobed nature of the blocking pad, wherein the practicing athlete may place his shoulder or his neck in the recess or concave area 54 between the pad lobes, and will more forcefully encounter the turning and twisting action of the pad against him, thereby requiring development of upper body strength as noted. As is evident also, the greater the applied attacking force of the blocker, the more rapidly the bar 36 will be urged rearwardly, and the applied torsional effect against the blocker will be enhanced. As the lobed pad turns further and further, the practicing player must not only continue his blocking force, but continually readjust his body to accommodate the shifting position of the pad lobes, as of course is the case during an actual game.

The L-frame 12 further includes means for retaining the slide block in a fully rearward position once so pushed there by the practicing player. To this end, means as a spring latch 70 having a downward hook 72 will yield upwardly to engage a fixed hook 74 at the rear of the slide block as the latter approaches, and thus will hold the block until released to avoid injury to the player by violent return movement of the block and pad under the force of springs 62 when player pressure is relieved. When desired or safe, catch 72 can be released by pressing upon lever end 76 thereof, for example.

In dimensional terms, the relation between the parts of my improved blocking sled for practical training purposes may include pad 44 as having a length of 3 feet, with the bottom of the pad about 1½ feet above the ground. The pad bar or rod 36 may have a length on the order of 9 feet, with at least 3 or 4 feet of effective pushback and torsion-imparting length, for example. Suitable lubrication or, as noted, friction-reducing material may be provided as requisite for the twist bar, the slide block and track, or any other movable components.

While I have described the best mode of my invention for imparting torsional forces during blocking practice sessions, it will be evident that variations and equivalents thereof may be devised to achieve like results within the scope of my appended claims that are other than the specific embodiment described.

What I claim is:

1. A football blocking practice sled comprising, an elongated frame having forward and rearward ends, and a blocking pad for engagement by a practicing athlete, means mounting said blocking pad on said frame for rearward movement of said pad along said frame in response to a blocking force, means yieldably resisting said rearward movement and to move said pad in a forward direction upon removal of the blocking force, and, the improvement comprising, means for imparting a lateral twisting movement to said pad in response to a blocking force and rearward movement of said pad.

2. The improved blocking practice sled of claim 1 wherein said mounting means is an elongated bar extending through an aperture in said frame.

3. The improved blocking practice sled of claim 2 wherein said means for imparting is a helical spline said bar in cooperating with fixed means in said aperture.

4. The improved blocking practice sled of claim 3 wherein said apparatus includes a slide block attached to said frame by a slide track to permit forward and rearward motion thereof, and wherein the other end of said bar is rotatably secured to said slide block.

5. The improved blocking practice sled of claim 1 wherein said pad has a lobed configuration having a central recessed areas between the lobes for engagement by a practicing player in obtaining pad-twisting practice.

6. A torsion-imparting football blocking practice apparatus comprising:

an elongated stationary frame having forward and rearward ends, a blocking pad, an elongated bar carrying said blocking pad at one end thereof, said frame having aperture means mounting said bar means for substantially horizontal longitudinal movement with respect to said frame means, means yieldably resisting said longitudinal movement of said bar, and, said frame and said bar having cooperating means for imparting rotation to said bar about its longitudinal axis thus providing twisting movement to said blocking pad relative to said frame.

7. The torsion-imparting blocking practice apparatus of claim 6 further including a longitudinally extending slide track on said frame, a slide block mounted for sliding movement in said slide track, and, means rotatably connecting the other end of said bar to said slide block.

8. The torsion-imparting blocking practice apparatus of claim 7 including means to releasably latch said slide block in a rearmost position against a forward-exerting force of said yieldably resisting means.

9. The torsion-imparting blocking practice of claim 7 wherein said yieldably resisting means comprises tension spring connected between said slide block and said frame means.

10. The torsion-imparting blocking practice of claim 7 wherein said pad has a lobed configuration having a central recessed areas between the lobes for engagement by a practicing player in obtaining pad-twisting practice.

11. The torsion-imparting blocking practice apparatus of claim 6 wherein said cooperating means for imparting twisting movement to said bar includes helical spline on said bar and inwardly extending teeth in said aperature on said frame.

12. The torsion-imparting blocking practice apparatus of claim 11 wherein said frame means includes an upstanding wall having said aperture therethrough, whereby relative movement between said aperture and said bar means causes rotaion of said bar means and thereby torsional movement of said pad.

13. The torsion-imparting blocking practice of claim 12 wherein said frame means includes a generally L-shaped frame having:

(1) an upstanding front leg, with said aperture in said front leg, and, (2) a substantially horizontal leg having slide track therein, said slide block being received by said slide track.

* * * * *